United States Patent [19]

Springer

[11] Patent Number: 4,842,082

[45] Date of Patent: Jun. 27, 1989

[54] VARIABLE OUTSIDE DIAMETER TOOL FOR USE IN PIKEWELLS

[75] Inventor: Johann Springer, Hanover, Fed. Rep. of Germany

[73] Assignee: Smith International (North Sea) Limited, Aberdeen, Scotland

[21] Appl. No.: 86,899

[22] Filed: Aug. 18, 1987

[30] Foreign Application Priority Data

Aug. 21, 1986 [GB] United Kingdom ..... 8620363

[51] Int. Cl.[4] ..... E21B 10/32; E21B 17/10; E21B 31/20

[52] U.S. Cl. ..... 175/279; 175/281; 175/284; 175/286; 175/321; 175/325; 166/98; 166/173; 166/174; 166/217; 166/241

[58] Field of Search ..... 175/325, 321, 230, 274, 175/277, 279, 280–284, 286, 288, 291; 15/104.15–104.19; 166/241, 301, 217, 137, 206, 138, 209, 190, 211, 173, 214, 174, 215, 216, 98

[56] References Cited

U.S. PATENT DOCUMENTS

| | | | |
|---|---|---|---|
| 1,726,079 | 8/1929 | Lyons | 175/325 |
| 1,801,334 | 4/1931 | Dalldorf et al. | 175/325 X |
| 1,898,074 | 2/1933 | Bailey | 175/325 |
| 1,908,594 | 5/1933 | Foster | 175/288 |
| 2,427,052 | 9/1947 | Grant | 175/286 |
| 2,500,125 | 3/1950 | Huber | 175/280 |
| 3,019,840 | 2/1962 | Kennard | 166/237 |
| 3,051,255 | 8/1962 | Deely et al. | 175/325 |
| 3,251,418 | 5/1966 | Condra | 166/173 |
| 3,749,167 | 7/1973 | Young | 166/217 |
| 4,000,549 | 1/1977 | Brumley et al. | 175/325 |
| 4,258,804 | 3/1981 | Richey et al. | 175/325 |
| 4,444,252 | 4/1984 | Fisher, Jr. | 166/217 X |
| 4,558,738 | 12/1985 | Howard, Sr. | 166/173 |

FOREIGN PATENT DOCUMENTS 916579 1/1963 United Kingdom .

*Primary Examiner*—Bruce M. Kisliuk
*Attorney, Agent, or Firm*—Ladas & Parry

[57] ABSTRACT

An apparatus for use in energy exploration is disclosed which is used where a radially expanding device is required, for example in a stabilizer, retriever or an underreamer. The apparatus comprises a support tubular member for connection to a drilling string, the member supporting a movable member which is axially movable along the member. A further member which may either be fixedly secured or also axially movable along the member is axially spaced from the movable member. The movable member and, optionally, the further member have tapered outer surfaces which cooperate with a taper on a radially movable member. The arrangement is such that movement of the movable member in the axial direction is such that the cooperating tapers cause the radially movable member to expand or contact in the radial direction. Various means for securing and performing radial movement are disclosed.

25 Claims, 12 Drawing Sheets

Figure 1:
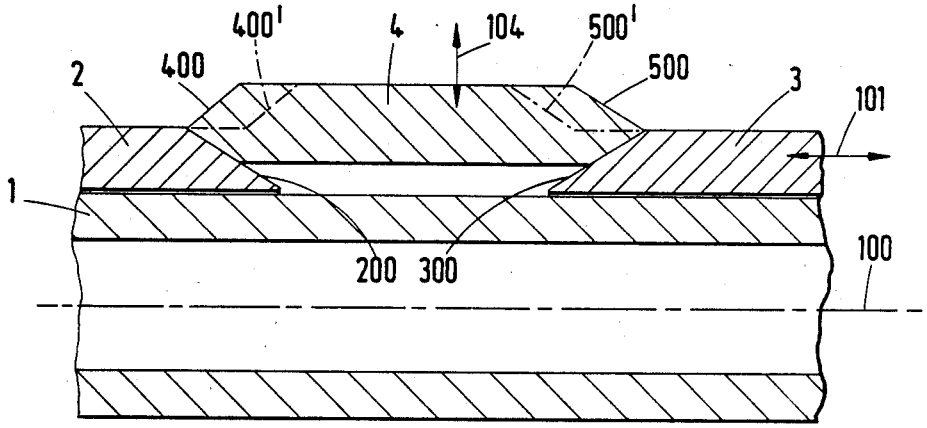

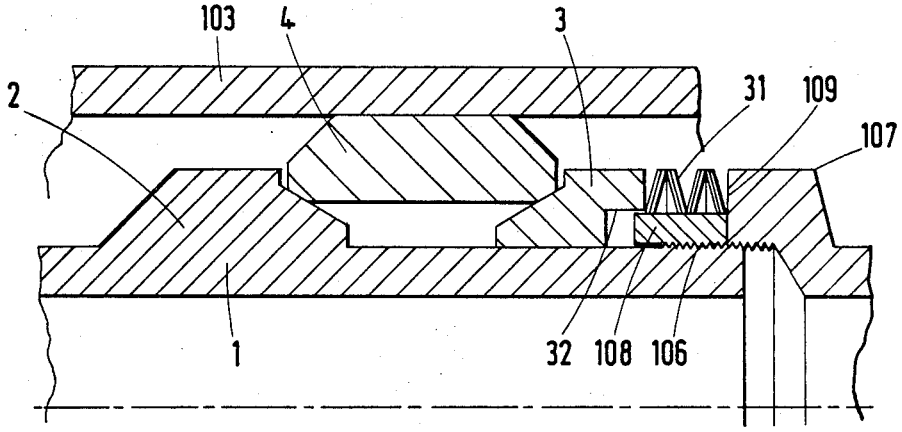
Fig.12
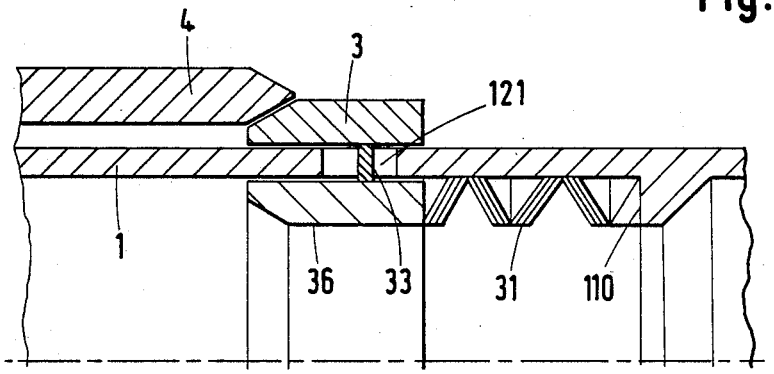
Fig.13
Fig.14
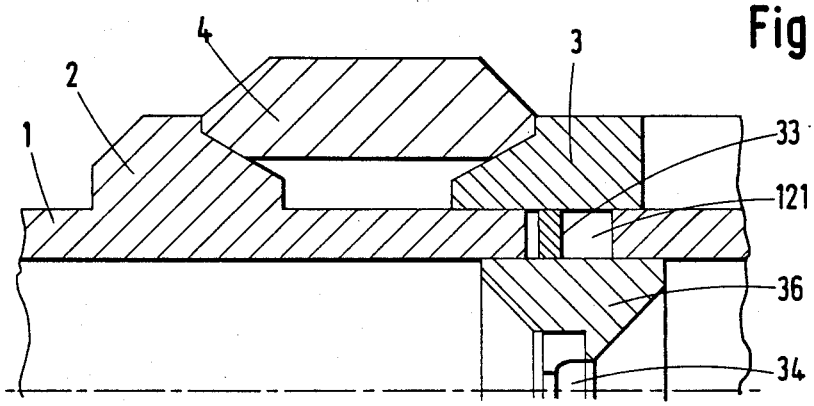

VARIABLE OUTSIDE DIAMETER TOOL FOR USE IN PIKEWELLS

This invention relates to a variable outside diameter tool for use in pipewells.

In energy exploration, such as drilling for oil or natural gas it is known that various components, such as underreamers, section mills, pipe cutters and so called "fishing" equipment for retrieving tubular members lost downhole are required to be radially expandable and contractable to pass through tubular obstructions so that they may perform their function. Hitherto such apparatus has each had a different mechanical arrangement for enabling the apparatus to be expandable and contractable and the solutions employed have sometimes used frangible elements to enable collapse such as in U.S. Pat. No. 3,019,840 or a J-slot arrangement.

The present invention seeks to provide an apparatus for use in energy exploration having a mechanical mode of operation which is common to a number of different tools and in which the apparatus is more readily expandable and contractable than are current tools.

According to this invention there is provided and apparatus for use in energy exploration including a support tubular member for connection to a drilling string, said support tubular member supporting a movable member which is axially movable therealong and a further member axially spaced from said movable member, a radially movable member located radially outwardly from said support tubular member by said axially movable member and said further member for movement toward or away from the longitudinal axis of said support tubular member, there being a cooperating taper on said radially movable member and at least one of said axially movable member and said further member such that relative axial movement of said axially movable member with respect to said further member causes movement along said cooperating tapers so as to effect radial movement of the radially movable member with respect to said longitudinal axis.

Preferably said radially movable member has a further taper on a side thereof remote from said members for abrading an obstruction in a pipe to force said radially movable member against at least one of the axially movable member and said further member to cause said axial movable member and said further member to vary the axial spacing therebetween so that the radial dimension presented by the radially movable member may be reduced.

Conveniently all of said members have a circular cross-section in a plane perpendicular to the support tubular member longitudinal axis although each may be formed by a plurality of segmental elements.

The movable and said further member may move longitudinally away or toward one another to effect radial expansion of said radially movable member.

The further member may be fixed in relation to the support tubular member or may also be axially movable in relation thereto.

In an embodiment of the invention the further member also has a cooperating taper with the radially movable member whereby relative motion between the axially movable member and the further member both cause the radially movable member to ride along the cooperating tapers to move radially. In another embodiment of the invention the axially movable member locates the radially movable member about flexing means which may be a pivoting means.

The further member may be one of integrally formed with the support tubular member, discretely formed and subsequently securely fixed to the support tubular member, and located on the support tubular member by a longitudinal spline to permit longitudinal movement thereof limited in movement by a resilient stop.

The axially movable member, the further member and the radially movable member may be arranged to rotate about the support tubular member or the movable member and the further member may be secured against rotational movement about the support tubular member.

Preferably the axially movable member and the radially movable member are integrally formed by a tubular sleeve having a plurality of longitudinal blind slots in the outer side wall thereof extending from an extreme outer end of the sleeve to a portion along the length of the sleeve to thereby provide spring fingers having radially movable outer ends, said outer end of the sleeve being radially enlarged on the outer surface thereof and provided with outer tapers facing in each logitudinal direction of the sleeve so that the sleeve can be both pushed through and retracted from a restriction, and another taper on an inner surface of the enlarged outer end being arranged to cooperate with the further member.

Conveniently a collapsible shield is provided radially inwardly of the fingers to prevent ingress of dirt.

Advantageously a key means is provided to prevent at least one of the axially movable member, the further member and the radially movable member from rotating.

Preferably the movable member and the further member are each rings which may be either solid rings or formed from a plurality of segments. Similarly the radially movable member may be an expandable continuous ring or formed from a plurality of segments each interlinked by a resilient member.

In an arrangement of the invention the support tubular member is provided with two axially spaced radially extending projections, spring means are provided on the axially outer sides of the projections and respective rings are urged outwardly by said springs, said rings each having a tapered outer surface to abraid with a cooperating tapered surface of a generally E-shaped radially expanding member, the centre limb of the E-shaped radially expanding member being located between the projections.

The axially movable member is conveniently urged in an axial direction by spring means which may be one of mechanical, pneumatic and hydro-pneumatic.

In an embodiment of the invention the support tubular member is arranged to be connected to a drill string, the axially movable member is arranged to be uppermost in the drill string above the further member which is secured to the support tubular member, a friction means is located below the further member for securing said support tubular member within a pipe against rotation therewith and said axially movable member is arranged to be displaced with respect to said further member by moving said drill string downwardly relative to said support tubular member to thereby expand the radially movable member against the inner surface of said pipe.

Conveniently the axially movable member is connected by an arm through a wall portion of said tubular member to a piston, and hydraulic means are provided for axially moving the axially movable member.

In an embodiment, a shoulder means is provided on at least one of said axially movable member and said further member which is engagable by said radially movable member to limit axial motion between said axially movable member and said further member toward one another and thereby limit the extent of radial expansion of said radially movable member. Alternatively a sleeve may be interposed between the axially movable member and the further member to limit the axial movement of said axially movable member toward said further member, and said sleeve may be integral with the axially movable member or the further member. In another embodiment the radially movable member is formed by a plurality of segments linked together by a lost motion coupling to limit the radial expansion thereof.

The support tubular member may be disposed about the circumference of a circular member with a shock absorbing means, such as an elastomeric element, disposed therebetween.

In an embodiment of the invention the further member is approximately L-shaped and the upright of the L of the further member is mounted in bearing means to be rotatable about the support tubular member and a radially outer surface of the upright portion of the L-shaped further member is arranged to support the axially movable member whereby the radially movable member is supported between the axially movable member and the foot portion of the L-shaped further member.

In one embodiment of the invention it is incorporated in a stabiliser and the axially movable member and the further member are each mounted on the support tubular member for rotation thereabout.

In another embodiment of the invention it is incorporated in an underreamer in which said further member is arranged to be fixedly secured to the support tubular member and the axially movable member is provided with releasable locking means to releasably secure said axially movable member in a position in which the radially movable member is contracted.

In a further embodiment of the invention it is incorporated in a retriever and said further member is fixedly secured to the support tubular member, said radial movable member is secured to the axial movable member whereby the radially movable member is flexed to move radially at the end thereof adjacent said further member when being expanded or contracted by said axially movable member moving the location of cooperating tapers on the radially movable and the further member.

According to a feature of this invention there is provided a drill string stabiliser comprising a tubular member externally circumferentially supporting a first rotatable circumferentially rotatable member and a second circumferentially rotatable member, the first and second members being provided with means for urging said members toward one another and both said members being axially spaced from one another and supporting a radially movable member, there being a taper on at least one of said first and second members cooperating with a taper on said radially movable member such that relative axial movement of at least one of said first and second members with respect to the support tubular member causes movement of said axially movable member along said cooperating tapers so as to effect radial movement thereof. In such a feature preferably the first member is secured against longitudinal movement and the second member is provided with means for effecting longitudinal movement thereof. Preferably the radially expandable member comprises a plurality of circumferentially disposed members each of which is radially expandable in dependence upon relative motion between the first and second members.

According to a further feature of this invention there is provided an underreamer comprising a support tubular member for connection to a drilling string, said support member supporting an axially movable member and a further member axially spaced from said axially movable member, a radially movable member located radially outwardly from said support tubular member by said axially movable member and said further member for movement toward or away from the longitudinal axis of said tubular support member, there being a taper on at least one of said axially movable member and said further member cooperating with a taper on said radially movable member such that relative axial movement of said axially movable member with respect to said further member causes movement along said cooperating taper so as to effect radial movement of the radially movable member with respect to said longitudinal axis. Preferably the further member is fixedly secured to the tubular member and the axially movable member is provided with releasable locking means to releasably secure said axially movable member in a position in which the radially movable member is contracted. Conveniently the releasable locking means comprises a piston assembly located within the support tubular member with a detent located in an outer peripheral wall of said assembly, a radially movable member mounted in the wall of said support tubular member and extending into the inner wall of said movable member, said movable member being biassed toward the further member by a spring means whereby in a first position of said piston said movable member is secured in position by said pin against the action of said spring means and in a further position of said piston said pin is withdrawn into said detent and out of the wall of said movable memans so that said movable means is urged by said spring means toward said further member to thereby radially expand said radially movable member. Normally the radially movable member is provided with cutting means on the radially outer surface thereof.

According to another feature of this invention there is provided a drilling string retriever comprising an apparatus for use in energy exploration including a support tubular member for connection to a drilling string, said support tubular member supporting an axially movable member which is axially movable therealong and a further member axially spaced from said movable member, a radially movable member located radially outwardly from said support tubular member and secured at one end to said axially movable member and at the other end thereof for movement on said further member, there being a cooperating taper on each of said further member and said other end of the radially movable member such that relative axial movement of said axially movable member with respect to said further member causes movement along said cooperating tapers so as to effect radial movement of said other end of the radially movable member with respect to said longitudinal axis.

Preferably the axially movable member is arranged to be moved toward the further member to radially expand the radially movable member. Conveniently the axially movable member is urged toward said further member by mechanical spring means and said radially movable member is integral with said axially movable member and has longitudinally flexible fingers.

Conveniently a counter bored sleeve is positioned on said support tubular member with the open end of said sleeve enclosing said axially movable member and said mechanical spring means is enclosed between the closed end of the counter bore and the axially movable member. Advantageously the position of the sleeve relative to the axially movable member is adjustable to vary the force exerted by the spring means.

Advantageously a key means is provided to prevent rotation of the axially and radially movable members with respect to the support tubular member.

In a preferred embodiment the support tubular member is connected to a drill string by a substantially parallel screw thread, adjacent the connection the support tubular member is located inside the drill string, a generally v-shaped notch is formed in the outer wall of the support tubular member and a locking means is inserted through the drill string onto a wall of the v-shaped notch to thereby prevent the support tubular member unscrewing from the drill string.

Preferably a collapsible shield is mounted between the radially movable member and the support tubular member to prevent ingress of dirt therebetween.

Figure 2:
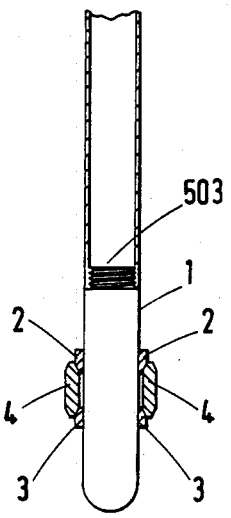
Figure 3:
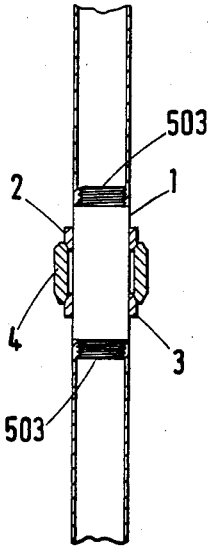
Figure 4:
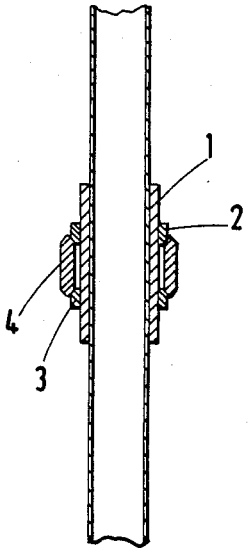
Figure 5:
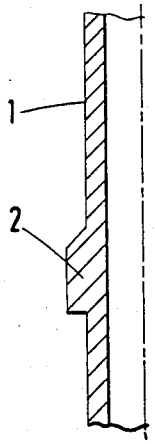
Figure 6:
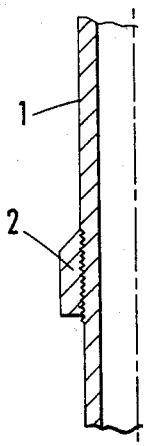
Figure 7:
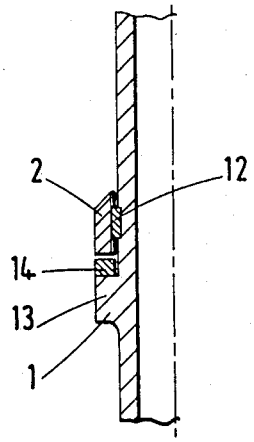
Figure 8A:
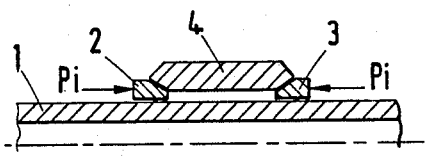
Figure 8B:
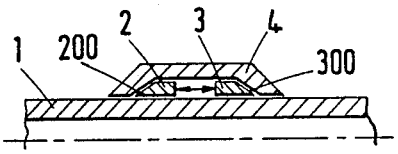
Figure 8C:
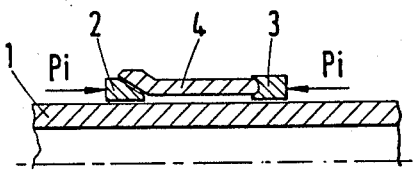
Figure 8D:
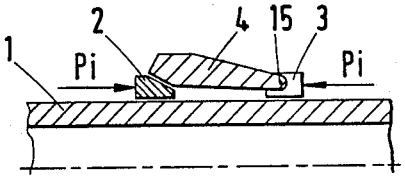
Figure 8E:
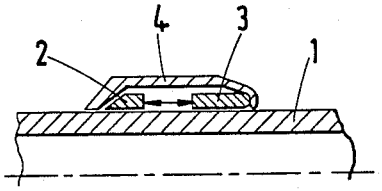
Figure 8F:
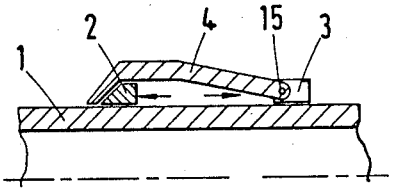
Figure 9A:
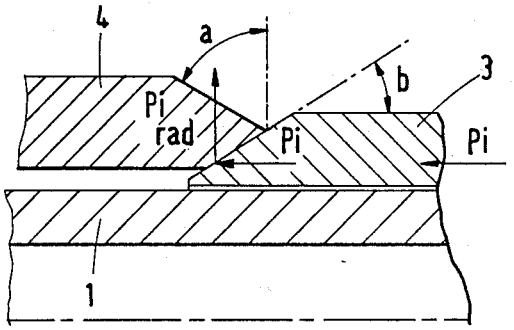
Figure 9B:
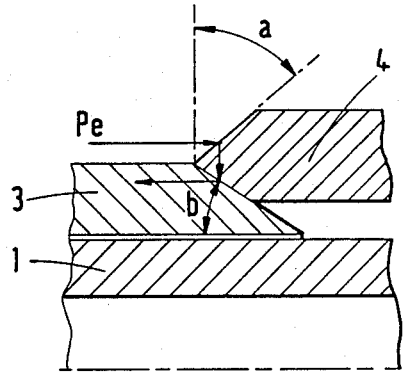
Figure 10:
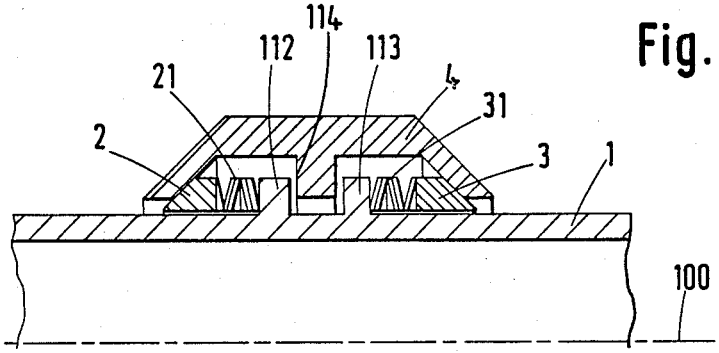
Figure 11A:
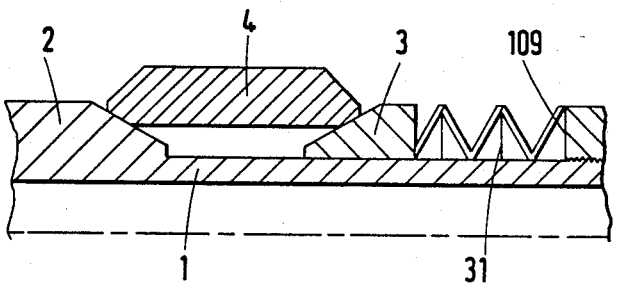
Figure 11B:
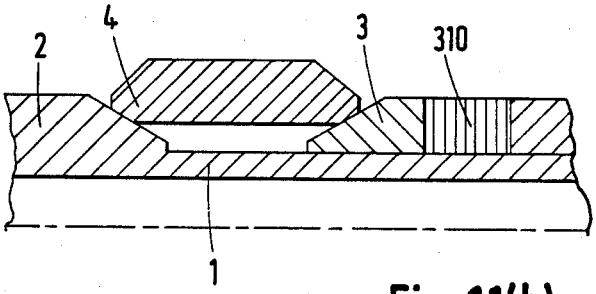
Figure 15:
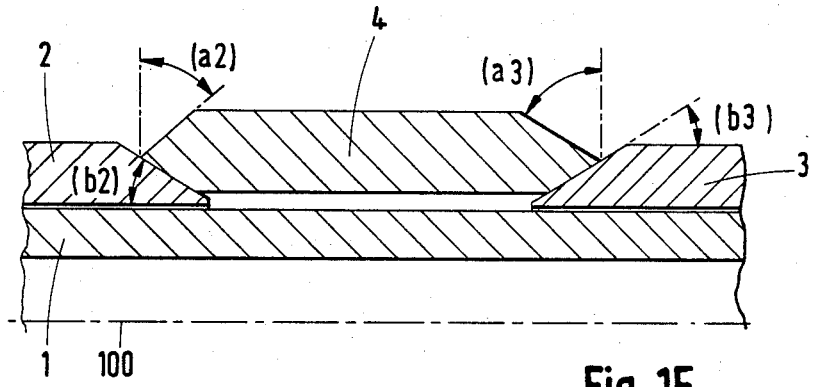
Figure 16:
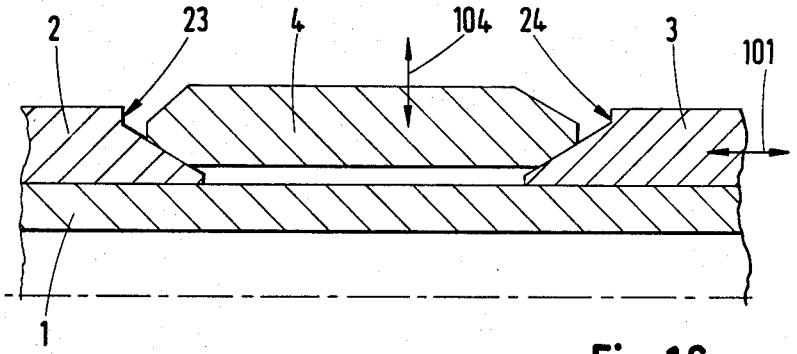
Figure 17:
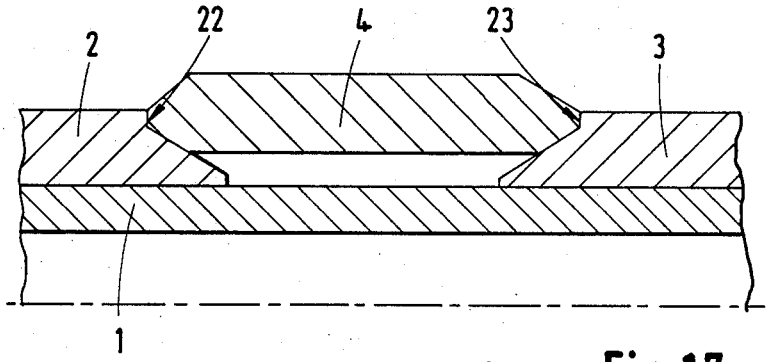
Figure 18:
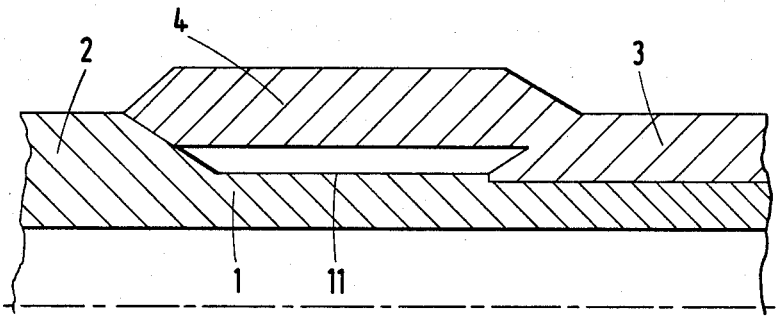
Figure 19:
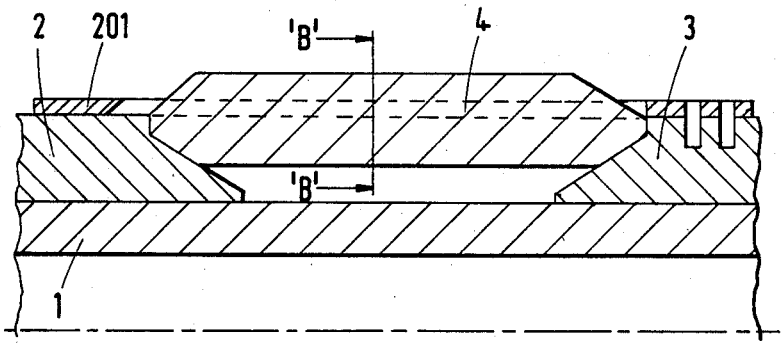
Figure 19:
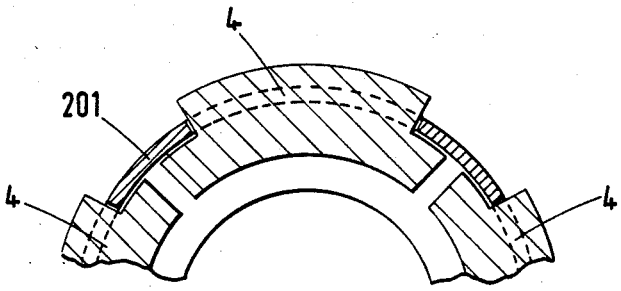
Figure 20A:
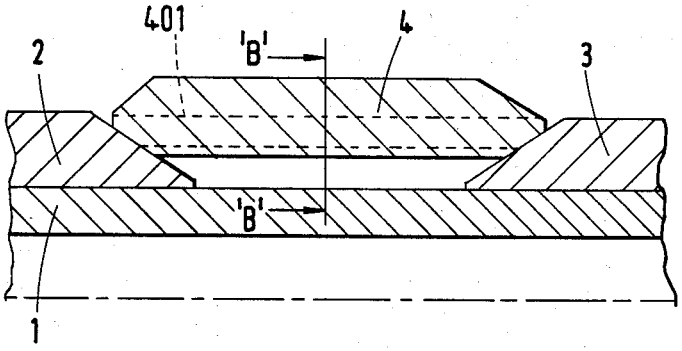
Figure 20B:
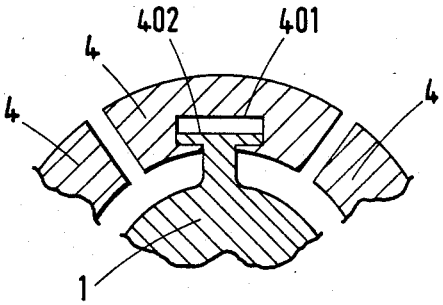
Figure 21A:
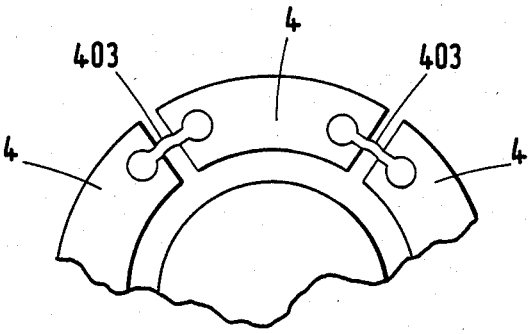
Figure 21B:
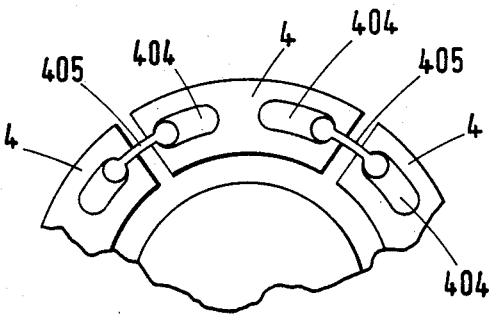
Figure 22:
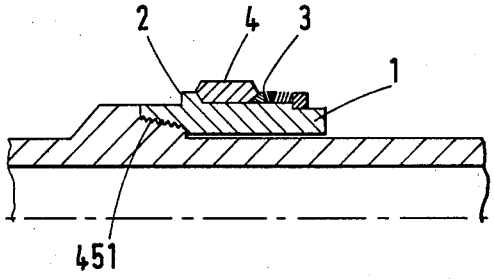
Figure 23:
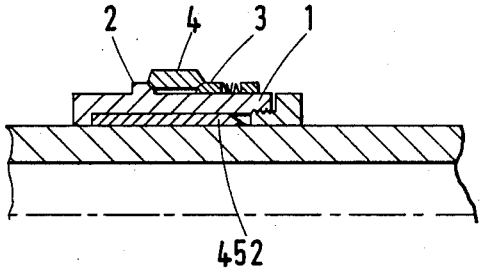
Figure 24:
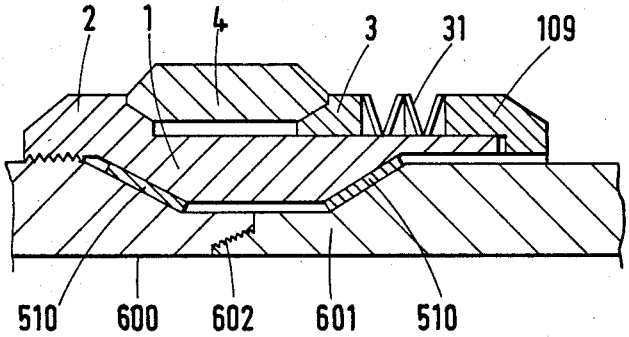
Figure 25:
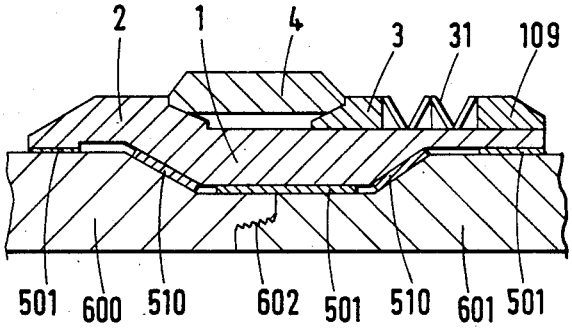
Figure 26:
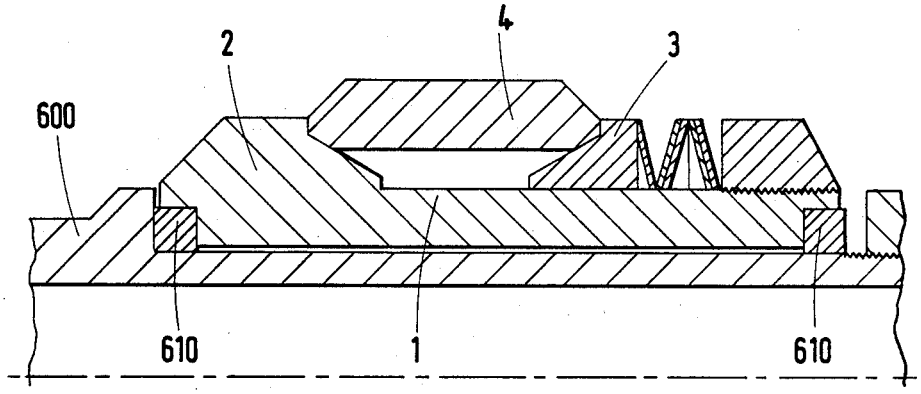
Figure 28A:
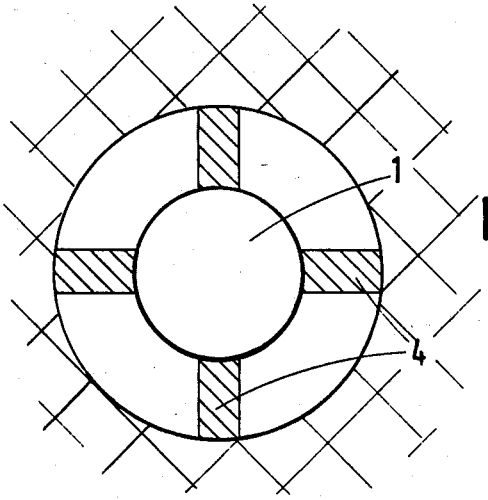
Figure 28B:
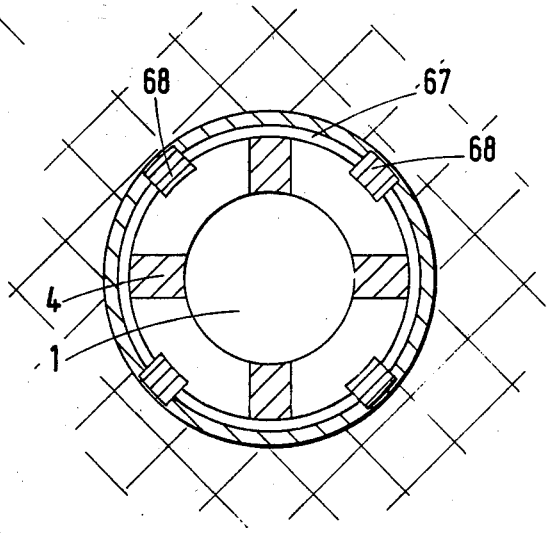
Figure 27:
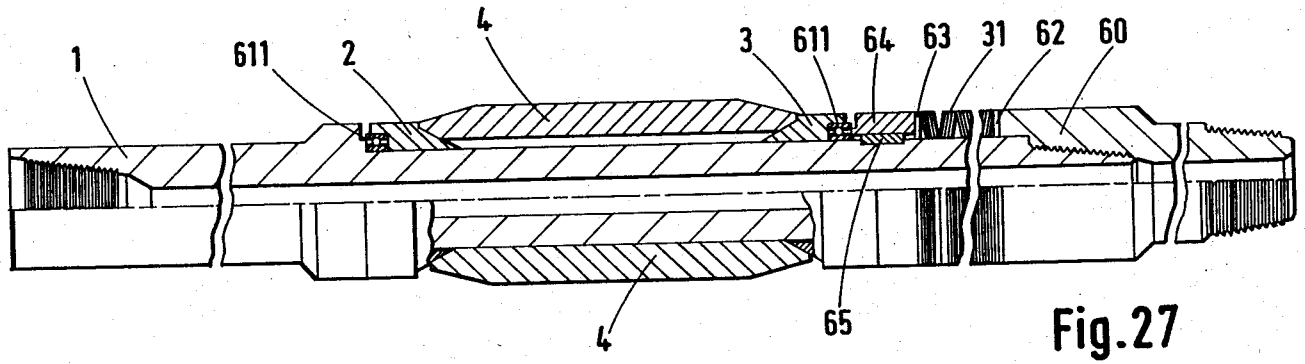
Figure 29:
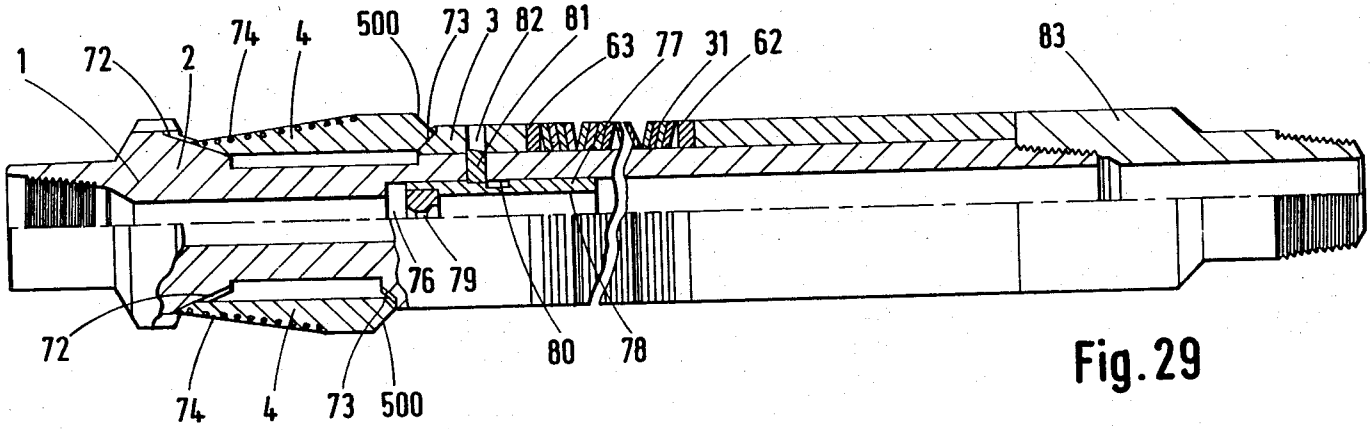
Figure 30:
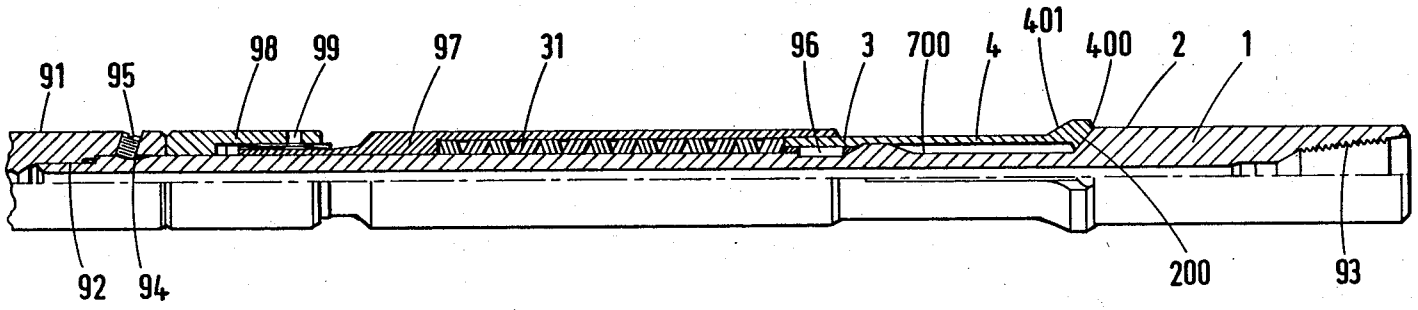
Figure 31:
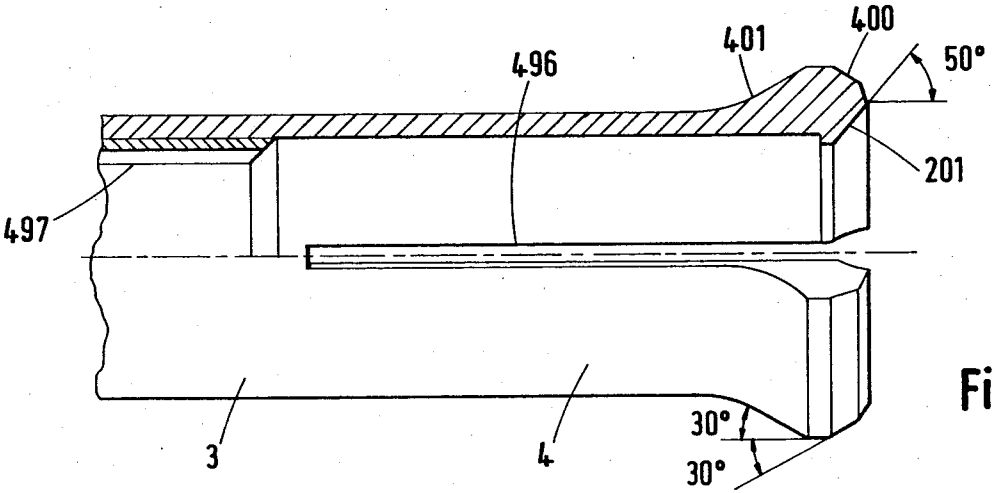

The invention will now be described by way of example with reference to the accompanying drawings in which:

FIG. 1 shows a longitudinal cross-section through an apparatus in accordance with this invention to demonstrate the basic integers and operating features thereof, FIGS. 2–4 schematically each show different locating positions of the apparatus on a drilling string, FIGS. 5–7 each schematically show different embodiments of the further member referred to in the statement of invention, FIGS. 8A–8F each schematically show different embodiments of the radially movable member and the manner of supporting the same, FIGS. 9(*a*) and 9(*b*) show the expanding and closing forces respectively on the radially movable member, FIG. 10 shows an embodiment for mitigating self locking of the radially movable member in which both members locating the radially movable member are axially movable, FIGS. 11(*a*) and 11(*b*) show different arrangements for applying expanding force to the radially movable member, FIGS. 12 and 13 each show different locations of a mechanical spring arrangement for applying expanding pressure to the radially movable member FIG. 14 shows a hydraulically operated arrangement for applying expanding pressure to the radially movable member, FIG. 15 shows the angles of taper required between the radially movable member and the axially movable member and the further member, and on the outer surfaces of the radially movable member remote from the axially movable member and the further member, FIGS. 16 and 17 show the radially expandable member in a contracted and an expanded position respectively in which shoulder stops are provided on the axially movable member and the further member for limiting radial expansion of the radially movable member, FIG. 18 shows an arrangement for limiting relative movement between the axially movable member and the further member toward one another, FIG. 19(*a*) and 20(*b*) show an arrangement for limiting relative movement between the axially movable member and the further member toward one another and in which FIG. 19(*b*) shows a partial cross-section along arrow headed lines B—B of FIG. 19(*a*), FIGS. 20(*a*) and 20(*b*) show another arrangement for limiting relative movement between the axially movable member and the further member toward one another and in which FIG. 20(*b*) shows a partial cross-section along arrow headed lines B—B of FIG. 20(*a*), FIGS. 21(*a*) and 21(*b*) show yet further embodiments of an arrangement for limiting relative movement between the axially movable member and the further member toward one another, FIGS. 22 and 23 each show different embodiments for attaching the support tubular member to a section of a drill string or work overstring or fishing string, FIGS. 24 and 25 show embodiments in which shocks applied to the radially expandable member may be absorbed, FIG. 26 shows an arrangement in which the radially expandable member may be freely rotatable about a drill string, FIG. 27 shows a partial longitudinal cross-section of rotating stabiliser utilising the apparatus of this invention, FIGS. 28(*a*) and 28(*b*) respectively show the apparatus of this invention in an expanded and collapsed condition when used as a non-rotating stabiliser and during a washover procedure, FIG. 29 shows a partial longitudinal cross-section of an underreamer utilising the apparatus of the present invention, and FIG. 30 shows, in partial longitudinal cross-section, a packer retriever using the apparatus in accordance with this invention, and FIG. 31 shows a detail of a catch sleeve used in FIG. 30.

In the figures, like reference numerals denote like parts.

The apparatus shown in FIG. 1 has a support tubular member 1 having a longitudinal axis 100 and about the outer periphery of which is located a circularly cross-sectioned ring 2 which may be fixed on the column or axially movable therealong. Spaced longitudinally from the ring 2 is an axially movable circularly cross-sectioned ring 3 movable in the direction of double arrow-headed line 101. The ends of the rings 2 and 3 adjacent one another are each provided with a respective taper 200, 300 which may be conical or pyramidal. Disposed so as to be supported on the rings 2, 3 is a radially movable member 4 movable in the direction of double arrow-headed line 104. The radially movable member 4 has tapers which cooperate with the tapers 200, 300 and in this manner the member 4 slides along the tapers 200, 300 in the direction of duble arrow-headed line 104. The radially remote outer end surfaces of the member 4 from the rings 2, 3 are each provided with tapers 400, 500 which may or may not be identical to one another in slope in dependence upon the use of the apparatus. Alternatively, as shown in chain broken lines, tapers 400′, 500′ may be positioned inwardly from the outer ends of the member 4. The purpose of the tapers 400, 500 is to enable the member 4 to abrade an obstruction in a pipe so as to force the member 4 inwardly against the tapers 200, 300. In FIG. 1 only one longitudinal half of the apparatus is shown since the apparatus is considered as being symmetrical about the axis 100.

The tubular member 1 may be an integral part of a drill string, workover string or fishing string connected by a single threaded connection to the bottom of such a string as indicated in FIG. 2 or with threaded connections 503 at each end of the tubular member 1 so that the apparatus is installed in an intermediate part of a drill string as shown in FIG. 3. In yet another alternative, shown in FIG. 4, the tubular member 1, instead of being a part of the length of the drill string may be located around the drill string either with or without some form of torque transfer device between the drill string and the column (as shown in FIG. 4).

As shown in FIG. 5, the ring 2 may be an integral part, i.e. formed with the tubular member 1. Alternatively, as shown in FIG. 6, the ring 2 may be initially formed as a discrete part and then securely fixed to the tubular member 1 by for example a screw thread, welding or riveting. Another manner of securing the ring 2 to the tubular member 1 as shown in FIG. 7 is to permit the ring 2 to be longitudinally movable on a spline or key 12 with movement of the ring 2 relative to the other ring 3 (not shown in FIG. 7) limited by a stop 13 on the tubular member 1 and an elastic cushion 14. It is also envisaged that the spline or key 12 may be omitted so that the ring 2 is freely rotatable and axially movable about the column 2.

With regard to the ring 3, this is free to move longitudinally along the tubular member 1 within predetermined limits and rotational movement of the column may or may not be transfered to the ring 3. Referring of FIG. 8(*a*)–8(*f*) there are shown various embodiments of the apparatus and the manner in which it may be assembled.

Referring particularly to FIG. 8(*a*) this shows essentially the arrangement of FIG. 1 but in which the rings 2, 3 are both longitudinally movable to apply force on the radially movable member 4 to move the member 4 radially outwardly and the inwardly directed force is denoted Pi. In FIG. 8(*b*) the radially movable member is shown as a shoe covering the rings 2, 3 and with the cooperating tapered surfaces 200, 300 being positioned on each of the longitudinally outer sides of the rings 2, 3 respectively. The radially movable member is thus moved radially outwardly when the rings 2, 3 are moved longiutdinally away from one another. In the arrangement of the apparatus shown in FIG. 8(*c*), the rings are again both movable in a direction toward one another as in FIG. 8(*a*) to cause the radially movable member 4 to expand but in this embodiment the end of the member 4 adjacent the ring 3 is pivotal by virtue of the end of the member 4 being arcuate with a similar curvature being formed in the ring 3. Thus in this embodiment a cooperating taper is provided only between ring 2 and member 4. A variation of this embodiment is to make ring 2 and member 4 integral and movable with one another and ring 2 stationary whereby cooperating tapers between ring 2 and member 4 cause member 4 to flex and thus radially expand at its end adjacent ring 2. The embodiment of FIG. 8(*d*) is similar to that shown in FIG. 8(*c*) except that the pivoting arrangement between member 4 and ring 3 is performed about a locating pin 15. The arrangement of the apparatus in FIG. 8(*e*) is generally a combination of the apparatus shown in FIGS. 8(*b*) and 8(*c*) in which the rings 2 and 3 are both movable outwardly with respect to one another to force the member 4 to expand but in which a cooperating mating taper is applied only to ring 2 and the adjacent part of member 4 with the end of the ring 3 contacting the member 4 being a pivotal connection formed by cooperating arcuate surfaces. Similarly FIG. 8(*f*) is effectively a combination of FIGS. 8(*b*) and 8(*d*).

The rings 2, 3 may either be solid rings or formed from a plurality of segment s and similarly the radially movable member 4 may be an expandable continuous ring or formed from a plurality of segments each interlinked by a resilent member as will be described later herein.

The general principal of operation of the apparatus will now be discussed.

Under the influence of an expanding internal force Pi, by which is meant a force produced by the apparatus itself, for example by springs or hydraulic pressure, so the rings 2, 3 are pushed against the mating inner surfaces of the radially movable member 4. Where these mating surfaces are conical or pyramidal, an outward radial force is created moving the member 4 away from the main assembly axis 100. Rings that do not have a tapered contact with the radially movable member 4 as in FIGS. 8(*a*), 8(*d*), 8(*e*), and 8(*f*), only allow the member 4 to swing around the non-moving end thereof while the other end is changing its outer diameter. The radial forces created by Pi depend on the magnitude of the force Pi, the angle of the tapered ring surfaces versus the main assembly axis and the friction between ring and member 4, these forces being shown in FIG. 9(*a*).

The closing forces are normally externally applied forces encountered by the apparaus, for example, meeting an obstruction in use. Thus where the apparatus of this invention is incorporated into a device which is pulled or pushed into an obstruction having an inner diameter smaller than the expanded diameter of the member 4 then the tapered section of the member 4 facing the obstruction is exposed to an external axial force Pe creating a radial closing force where Pe acts against the taper-see FIG. 9(*b*).

While pulling or pushing the apparatus of this invention through a well section with an internal diameter smaller than the expanded diameter of the member 4, or under the influence of gravity in holes which are other than vertical, or due to longitudinal bore hole curvature, then the member 4 is exposed to a variety of radial closing forces. When raising or lowering the present apparatus these forces will create axial friction which must be taken into consideration when the tapered angles of the apparatus are calculated. In cases where this friction could lock the tool open a special arrangement of rings may be used on the tubular member 1 and such an arrangement is shown in FIG. 10, which is a variant of the embodiment shown in FIG. 8(*b*) and has the tubular member 1 formed with two radially outwardly extending projections 112, 113 axially spaced from one another. The sides of each of the projections remote from the other projection acts as a stop surface against which a spring or springs 21, 31 act for exerting an axial movement against rings 2, 3 respectively. Located between the projections 112, 113 is a limb 114 of the member 4 and the purpose of the projections 112, 113 and the limb 114 is to ensure that the member 4 can move only in a radial direction; in this manner the locking problem noted above is essentially overcome.

The radial closing force resulting from all the external forces acting on the apparatus is split between the rings 2 and 3 which act as points of support for the member 4. Where the radial force acts against a tapered ring, an axial force is created which opposes the internal opening force Pi, e.g. provided by the springs 21, 31.

The magnitude of this axial force is the result of the value of the radial closing force acting against that ring, the angle between the tapered surface of the ring and the main assembly axis and the friction between ring and member 4. Friction of course always acts against any movement, opening or closing of the member 4. When this axial force at one of the rings 2, 3 exceeds Pi the radially movable member 4 will collapse at this end of the apparatus. On the other hand when the force Pi exceeds this axial force at one of the rings 2, 3 the member 4 will expand.

In FIG. 9 the different sources of force Pi are shown in a FIG. 8(*a*) situation although it will of course be realised that the same sources of force Pi may be selected for the other embodiments shown in FIG. 8(*a*-)-8(*f*).

Various arrangements for applying the force Pi may be provided by mechanical, pneumatic or hydro-pneumatic springs or combinations thereof. FIG. 11(*a*) shows an arrangement in which mechanical springs 31 are used and FIG. 11(*b*) shows an arrangement in which a pneumatic or hydro-pneumatic spring element 310 is employed. Springs as a source of force Pi exhibit the major characteristics that once run into a well no hydraulic or mechanical action is required to maintain the apparatus's expanding forces and the further external closing forces met when the apparatus meets with an obstruction collapse the member 4 with an increasingly higher force Pi as the springs compress.

In the embodiment of FIG. 12*a* member 107 is provided with a support ring 108 on which is located the spring 31 and member 107 has a face 109 acting as an abutment stop for the spring 31. The ring 3 is provided with an undercut portion 32 into which the support ring 108 may move. Thus an initial force pressure Pi may be applied against member 4 by the spring 31 and upon further screwing member 107 along the tubular member 1 so the support ring 108 may be brought into mechanical contact with ring 3 so that an increased expanding force may be applied to member 4.

Another arrangement similar to that shown in FIG. 12 is illustrated in FIG. 13 except in this arrangement the springs 31 are mounted inwardly of the tubular member 1 instead of on the exterior surface. Thus the tubular member 1 is provided with an interior stop surface 110 and the ring 3 has an interior, of the tubular member 1, ring 36 interlinked with the exterior part of the ring by a bridge 33, the bridge 33 acting in a slot 121 in the wall of the tubular member 1. Such an arrangement has the advantage that the springs 31 are not exposed to the well bore environment so that formation solids and other cuttings are less likely to interfere with the proper functioning of the springs although it will be necessary to provide seals in the slot 121 to insulate the inside of the member 1 against the outside thereof.

A hydraulic manner of providing the force Pi is shown in FIG. 14 in which ring 3 again has a bridge 33 acting in a slot 121 and has an inner ring 36 but in this instance the inner ring 36 has a hole 34 of a smaller internal diameter than that shown in FIG. 13 so that ring 36 acts as a piston. In operation fluid is pumped through hole 34 in the direction of ring 2 and due to a pressure difference being built up between opposing surfaces of the ring 36 so it acts as a piston to move toward ring 2 and thereby due to the integral relationship between parts 36, 33 and 3 so member 4 is moved radially outwardly. It will be realised that the fluid may be liquid or gas.

Depending on the requirements for a particular use of the apparatus combinations of different sources acting inside and/or outside the tubular member provding force Pi may be chosen, for example an outside mechanical spring may be assisted by inside hydraulic pressure or an internal hydraulic force may be used to create a force counteracting an outside mechanical spring.

The manner of selecting the various taper angles will now be discussed.

Exploration tools are built for a wide variety of applications, each requiring different internal and external forces and also having specific outside diameter changes between a fully collapsed and completely expanded position of the radial movable member 4. Some tools may need a large contact area between the member 4 and the surrounding bore hole wall, such as in a stabiliser, while other tools may require high radial forces concentrated on a small area, for example in a pipe cutter. For yet other requirements a tool may require a preset internal force to function independently of hydraulic or mechanical manipulation, for example in a retriever or packer catcher, and for some tools mechanical or combined sources or release mechanisms for a preset internal force Pi may be chosen, such as a release mechanism for an underreamer.

Referring now to FIG. 15 the angle of taper on the exterior surface of member 4 adjacent ring 2 is (a2) taken perpendicularly to the longitudinal axis 100 and similarly angle of taper (a3) is the outside surface angle of the member 4 perpendicular to the axis 100 adjacent to the ring 3. The angle (b2) and (b3) are the angles of taper with respect axis 100 of the rings 2 and 3 respectively and of the parts of the member 4 which cooperate with the tapers on members 2 and 3.

To prevent self-locking of the expanding and collapsing member 4 the angles (b2) and (b3) have to be within the following range:

Arc tan (f r/e)<[(b2)] less than [90-Arc tan (f r/e)]

Arc tan (f r/e)<[(b3)] less than [90-Arc tan (f r/e)]

where f r/e is friction factor between each of the rings and the radially movable member 4, and if f e/w is the friction factor between the member 4 and the surrounding bore hole wall, casing or equipment, the angles (a2) and (a3) have a general limit of:

Arc tan (f e/w)<(a2)

Arc tan (f e/w)<(a3)

to enable the member 4 to collapse.

If the apparatus is to be used in a particular fashion then special considerations may apply, for example if the apparatus is required to pass through a tapered restriction only if a predetermined force Pe is exceeded, the angle used to calculate the radial force resulting from Pe is either (90-taper of restriction) or a2 (or a3 if applicable) whichever value is higher. Additionally, depending on the friction between the member 4 and the surrounding wall of the pipe an axial force is created when the apparatus is moved up or down. In the direction of ring 3 this friction force must be lower than Pi. If it exceeds Pi the member 4 is axially lifted off ring 2.

Once the source and amount of the internal force Pi is selected and the requirements of radial as well as axial external forces is specified, the angles are partially chosen with the foregoing limits borne in mind and partially calculated using principles well known per se applicable for inclined planes. Since friction opposes movement care has to be taken when for example either a specific radial force is required while the members 4 are expanding or collapsing at a specified axial load.

It will be realised that unless some means were taken to prevent it, the internal forces Pi would increase the diameter of the member 4 until it slid over the rings 2, 3. To prevent such an over-expansion shoulders 23, 24 are provided on the rings 2, 3 to limit the axial movement of the rings and the position of the member 4 in a collapsed condition is shown in FIG. 16 and in an expanded condition in FIG. 18 in which the shoulders 23, 24 forcefully contact the outer surfaces of the member 4 to limit the expansion thereof (FIG. 17).

In another embodiment, shown in FIG. 18, member 4 is flexibly, integrally connected with ring 3 and ring 2 is integral with member 1. The radial expansion of member 4 is limited by a sleeve or radial expansion 11 of the tubular member 1 against which ring 3 may abut. In another embodiment, shown in FIGS. 19(*a*) and 19(*b*), a cage 201 is used having apertures therein to permit a portion of the member 4 to expand therethrough but which is arranged to block excess radial movement of the member or members 4.

In yet another embodiment, shown in FIGS. 20(*a*) and 20(*b*), a T (or dove-tail not shown) shaped slot 401 is provided in the member 4 with a correspondingly shaped part 402 being provided either on the tubular member 1 (or one or both of the rings 2, 3 not shown) to mechanically limit the radial movement of the member 4.

Another arrangement for limiting the maximum expansion of the members 4 is shown in FIG. 21(*a*) in which the member 4 is formed from segments and adjacent parts of the segments are interconnected by an elastic strip 403 having a wire strap inserted therein such that the members 4 are permitted to expand against the elasticity of the strip until limited by the wire strap.

Yet a further embodiment is shown in FIG. 21(*b*) in which slots 404 are provided in adjacent members 4 and a captive wire strip 405 is used to interconnect the slots 404 in a lost motion fashion.

The apparatus may be attached to an integral member of a drill string, work overstring or fishing string by securement of the tubular member 1 thereto by many different arrangements which will be readily appreciated by those skilled in the art, for example a threaded conncetion 451 as shown in FIG. 22 or a friction grip 452 as shown in FIG. 23.

In currently existing drilling string tools a shock absorber, if provided, is installed as part of the drill string but is located above and therefore at some distance from the actual machining tool. In the present invention it is possible to arrange the shock absorber to be advantageously very close to the machining tool and in this respect the member 4 could support or in fact form part of a machining tool.

In this regard reference is made to FIG. 24 in which an elastomeric element 510 is disposed between a tapered surface on the inside diameter of the tubular member 1 and a corresponding taper on each of two sections of a drilling string 600, 601 interconnected by a tapered screw thread 602. The manner of locating the elastomer elements 510 is to firstly load the elastomer element adjacent ring 2 and string section 600 then to screw in the other section 601 to section 600 until the elastomer element adjacent section 601 is abutted then to release the loading so that an even balance is provide between the elastomer elements 510. In this manner radial, torsional and longitudinal shocks and stresses may be reduced.

FIG. 25 shows an arrangement in which torsional and longitudinal shocks only may be absorbed and in this embodiment supporting bearing rings 501 are provided betweeen the tubular member 1 and drilling string sections 600, 601 on each side of the elastomer elements 510.

In some uses of the present apparatus in a tool it may be required for the apparatus to be freely rotatable about a drilling string and such an arrangement is shown in FIG. 26 where bearings 610 are interposed at each end of the tubular member 1 and the drill string 600. Frictional or roller bearings may be used or in cases where slight tolerances are acceptable no bearing may be installed between the tubular member 1 and the drill string 600.

If it is required for there to be provided torque transfer from tubular member 1 to the radially movable member 4 this may be achieved by providing longitudinally disposed splines between the rings and the member 4.

Some applications of the present apparatus will now be described and it is to be understood that the present apparaus may be used with exploration tools such as a stabiliser, a casing scraper, an underreamer, a pipe cutter, a section mill, or a retriever spear. This list is not intended to be exhaustive.

Three of the typical uses of the present apparatus will now be described:

Stabiliser

To reach a planned target point in directional wells and/or to maintain direction or deviation within acceptable limits the use of stabilisers in the bottom hole assembly of a drill string is essential. Besides the optimum placement of stabilisers in a drilling string the clearance, i.e. difference between the hole internal diameter and the stabiliser outside diameter, is of greatest importance since the smaller the clearance, the better is the stabilisation. However on a conventional stabiliser there must be some clearance otherwise there is a danger of the stabiliser becoming stuck while running the stabiliser into the hole or pulling upwardly on the drilling string.

The stabiliser embodying the present invention shown in FIG. 27 has the tubular member 1 formed as part of the drilling string so that a conical female thread is provided at the left hand end of the column (as viewed in FIG. 27) and a male screw thread is provided at the right hand end of the column for securement to a bottom sub 60. The rings 2 and 3 are supported on bearings 611 for rotational movement about the tubular member 1. The spring 31 is located between a non-axially movable wear ring 62 and an axially slidable wear ring 63. The ring 63 abuts a distance ring 64 which is located on a longitudinal key 65 and the bearing supporting ring 3 is also arranged to be longitudinally slidable. The members 4 are arranged in segments and may take the form of the arrangement shown in FIG. 21(*a*). In the FIG. 27 the upper member 4 is shown in an expanded condition and the lower ring is shown in a contracted position although of course it will be realised these positions are shown purely by way of example since it will be realised that in an operational embodiment the members 4 will expand and contract in unison. The pressure exerted by the spring 31 is arranged so that the members 4 will expand into contact with the bore hole wall and thus hold the rotating drill string centrally within the hole.

The stabiliser of FIG. 27 has many advantages over all the conventional, known stabilisers:

1. Because the outside diameter of the members 4 is variable, the bottom hole assembly rotates around the centre of the well at the point of stabilisation independent of the actual hole diameter whereas with the known stabiliser, a clearance is necessary so it cannot be a tight fit therein and as a result permits wander of the assembly.
2. The internal forces, i.e. springs 31 keep the members 4 open against radial forces caused by buckling of the drill string gravity, formation reaction at the bit or hole curvature.
3. The top and bottom outer surfaces of the members 4 are tapered to allow easy collapse when running or pulling the stabiliser through restrictions and in this manner the tool does not become stuck in an undergauge section which is a possibility with the fixed blades of prior art stabilisers.
4. Because the radially movable members 4 centrally stabilise the bit so a drilling bit runs exactly about its centre thus increasing bit life and performance.
5. Because the bit does not "walk" at the bottom of the hole, the hole is drilled to gauge.
6. It will be realised that clearance between a stabiliser and the hole internal diameter is ideally zero but because a clearance is needed with existing stabilisers wear of the stabiliser blades and/or oversize holes prohibit such an ideal whereas the expanding stabiliser of this invention enables zero clearance.
7. Without an increase in weight on the drilling bit versus the standard bottom hole assembly the present invention results in a straighter hole, i.e. when drilling a "straight" hole a predetermined force is applied to a tool but if the force is increased to drill faster then the drilling bit tends to deviate more from a straight line. With the present invention, because the stabiliser is a tight fit in a hole so a greater force can be applied to the drilling string without the drilling bit deviating from its required "straight" course.
8. The stabiliser of this invention can be used in hole sections that are underreamed, i.e. under a casing with a smaller inside diameter.

The present invention has the following advantages over stabilisers which rotate with the drilling string:

1. Since the present invention stabiliser does not rotate with the drilling string it does not radially cut into the bore hole wall even when higher radial forces exist.
2. The wear on the stabiliser members 4 of this invention is a result of vertical movement in the well only and low wear of the members is achieved since rotation of the string is not transferred to the members.
3. The known rotating stabiliser is necessarily smaller than the hole internal diameter, the longitudinal centre of the hole and of the stabiliser are not identical. The present invention overcomes this disadvantage by directly centering the stabiliser within the hole and even with slightly worn radially expanding members 4 the blades will still expand to take up any wear to thereby improve drill string stabilisation.

A conventional non-rotating stabiliser is located on a drill string by bearings and is radially expanded at a given point in a well but the radially expanded fins or blades are then set and are not capable of contraction. Thus the conventional non-rotating stabilisers have blades which are made of a rather soft material such as rubber which can easily be cut away, a process known as "washing over" in the the event that the drill string becomes stuck in the hole below or at the stabiliser. In distinction the stabiliser of this invention is able to incorporate radially expandable members 4 which can be made of the toughest possible material and washing over does not destroy the blades since the blades collapse to fit inside the washover shoe and washover pipe. During a washover operation the member 4 internally centre the washover pipe around the drill string, protecting the drill string components with a larger outside diameter which prevents parts of the drill string with an outside diameter smaller than the inside diameter of the washover shoe from being destroyed. A schematic horizontal cross-section of the expanded and collapsed positions of a stabiliser are shown in FIGS. 28(*a*) and 28(*b*) respectively in which the washover pipe is referenced 67 and the washover shoe (mill) is referenced 68.

Underreamer

Oil wells are usually drilled and completed by sections of a well being drilled one at a time, casing run to the bottom of that section and then that casing being cemented in position. Normally, the next subsequent depth interval has to be drilled from a drill string which passes through the thus fixed casing so that the following depth interval has to be drilled with a bit that has an outside diameter which is smaller than the drift internal diameter of the previous casing string. The result of this normal procedure is a casing and a bit programme starting with a large surface hole and casing size to be able to complete the hole planned total depth with a casing size of much smaller diameter at the bottom which is considered suitable for production.

The difference in diameter between the bore hole and the subsequent casing is determined by the requirements of the cementing procedure to be used in cementing the casing in position. In this respect the hydraulic friction pressure losses while applying the cement would be excessive if the annulus between the casing and the bore hole were too small, but if the annulus exceeds an optimum size the quality of the cement sheath around the casing is degraded.

A common underreamer is a drilling tool that has a variable diameter so that it can pass through restrictions such as a previously installed casing. So as to pass through such restrictions the underreamer has arms which are retracted but once the arms have passed through the restriction they are hydraulically opened so that the size of a pilot hole may be increased. This pilot hole may be drilled by a bit attached to the bottom of such an underreamer or may have been drilled in a separate operation prior to running the underreamer.

Underreaming a section beneath an already cemented casing string allows a larger casing in the next depth interval to be installed so that the difference in size between adjacent casing sections are smaller than when using the normal procedure described above. Thus for a predetermined identical size of the lowermost final production casing it will be realised that the uppermost casing can be made with a smaller diameter when using an underreaming procedure than when using the normal procedure. Savings in steel, drilling field chemicals, cement, and the amount of solids removed and disposed, as well as well head blowout prevention equipment when using an underreaming procedure can be in the range of 30–40% compared to a well drilled using the normal procedure.

Existing underreamers have two or three expandable arms which are each dressed with roller cones or diamonds (artificial diamond or natural diamond) have so far not been reliable nor efficient enough to be used extensively. This is because existing underreamers may either cause additional drilling costs exceeding the savings mentioned above because of short tool life, slow penetration rates, fishing operations resulting from weak tools or they may drill holes that are smaller than the planned diameter if the arms are either not fully opened or are worn due to insufficient gauge protection or they may become locked opened or they may be simply not suitable for simultaneous drilling and underreaming for technical or deviation control reasons.

The underreamer utilising the apparatus of this invention mitigates the above disadvantages and may drill as fast in combination with a shear type bit as the bit alone would drill. Moreover an underreamer incorporating the present invention apparatus has a positive opening and closing system and moreover the bolts that are required in conventional underreamers to support the arms which weaken the tool body are unnecessary. The underreamer disclosed herein should therefore allow a user to benefit from the huge savings indicated above in the range of 30–40% by using modified casing programmes.

Referring to FIG. 29 the underreamer shown has a number of radially movable members 4 arranged to be slidable along longitudinal splines 72, 73 on the rings 2, 3 respectively. The cutting surface 74 of the member 4 is dressed with diamond or the like. The length of surface 74 that is dressed is arranged to be sufficiently long so that one rotation of the drill string moves the tool down less than the dressed length to thereby avoid a spiral groove formation in the hole and thus a disadvantage of a conventional underreamer is overcome. Machined in a recess in the interior of the tubular member 1 is a radially expanded chamber 76 in which is located a hydraulic piston assembly 77 comprising a sleeve 78 supporting an apertured piston 79. Circumferentially disposed counter-bored holes 80 are provided in the outer wall of the sleeve 78 for cooperation with a like number of circumferentially disposed locking pins 81 which each slide through a bore in the tubular member 1 and ring 3. The radially outer surface of the pins 81 have a sloping upper surface 82 which faces the spring 31 and the ring 3 is arranged to abrade against the sloping surface 82.

In FIG. 29 the upper member 4 is shown in a contracted position whereas the lower member 4 is shown in an expanded position although it will of course be realised that the members 4 will move in unison, the different position being shown for illustration purposes. Also in the figure the tubular member 1 is connected to a top sub 83.

In operation, with the piston assembly 77 in the position shown in FIG. 29, the pins 81 rest upon an outer surface of the sleeve 78 and counteracts the force of the spring 31 against ring 3 so that the radially movable members 4 are contracted. A pilot bit is connected to the bottom of the underreamer. In this position the underreamer is connected to a drilling string and lowered through an already installed pipe until the underreamer is beneath the thus installed pipe whereupon fluid is passed through the central bore of the tubular member 1 to move the piston assembly to the left as shown in FIG. 29. The action of moving the piston assembly to the left brings the holes 80 radially below the pins 81 so that the pins are forced by the ring 3 acting upon the surface 82 into the respective holes 80. As a result ring 3 moves toward ring 2 and the radially movable members are thus driven along the tapers 72, 73 to an expanded position. A taper 500 on the upper (in use) surface of the members 4 enables the members to collapse to be withdrawn through the pipe. In an alternative embodiment members 4 are connected to ring 3.

Packer Retriever

It is well known that when an oil or gas well is sealed, it is sealed by what is known as a packer which is a sealing member having radially extending upper slips or barbs that secure the packer against upward movement in the well bore and also radially extending lower slips or barbs that prevent the packer from being pushed downwardly into the well.

It is often required after a well has been sealed by a packer for it to be reopened and it is then necessary to remove the packer and it is accordingly necessary to destroy the upper slips and usually the lower slips also have to be destroyed as well as the material, principally rubber and steeel rings located between the upper and lower slips.

Especially in shallow wells producing from a single hydrocarbon formation near the bottom of the well it is usual practice to mill or drill away as much of the packer as is necessary to be able to push the remnants of the packer to the bottom of the well. The remnants are then either left at the bottom of the well or destroyed.

In many cases however it is not possible to push a packer to the bottom of a well since other equipment may be installed below the packer further down the well which could become blocked by the packer debris. With the present deep and ultra deep wells now being worked and in particular in off-shore operations where the cost of one hour's oil rig time might exceed U.S. $2,000, it is clearly required that a packer slips be destroyed so that the packer may be removed in a single stroke of the drilling string. However until recently it has been common practice for the packer slips to be destroyed and for a retriever to be run into the well to engage the bore of the packer so that the packer is removed from the well. Such an approach requires two strokes i.e. going down and up twice of the drill string, for removal of the packer and such procedure can take up to ten hours or more. Moreover it frequently happens that the remnants of the packer become stuck further up the well and the complete procedure has to be repeated. Since with present day deep and ultra deep wells it is necessary to completely remove packers from a well instead of pushing them to the bottom of the well, packer catchers were evolved which are able to pass through a packer to be located beneath the packer and then a hollow or pilot mill is used to cut away the packer slips whereupon the packer falls onto the catcher as disclosed in U.S. Pat. No. 2,904,114 so that the milling and retrieving operation can be performed in a single stroke of the drill string.

All the commercially available packer catchers have spring loaded fingers which are able to be collapsed during passage through the packer and which open once beneath the packer to have a diameter which exceeds the inside diameter of the packer to be retrieved. Pulling on the drill string moves the packer catcher upwards and either a downwardly expanding cone or the outside diameter of the catcher prevents the fingers from collapsing to a diameter smaller than the packer inside diameter.

Because in withdrawing a packer the packer sometimes becomes caught on an obstruction within the well it is necessary if the drill string is not to be damaged, for the spear to release the packer and one such device is described in U.K. Pat. No. 916,579. However because the device described in the U.K. Pat. No. 916,579 relies upon interengaging screw threads to release the catcher for withdrawal it is not readily possible to re-enter the packer unless the drill string is completely withdrawn and the device reset. Some other arrangements such as disclosed in U.S. Pat. No. 3,019,840 use frangible pins for supporting the catcher spring fingers which break to permit the fingers to collapse so that they can be withdrawn through the packer if an obstruction should be met. Thus in these arrangements if an obstruction is met it is again necessary for there to be two strokes, at least, of the drill string for the packer to be removed.

So as to overcome the problem of requiring at least two strokes of the drill string if a packer should become caught on an obstruction an arrangement involving the use of a J-slot is used to enable the packer catcher fingers to collapse so that the catcher can be pulled upwardly through a bore of the packer. Simply lowering the catcher brings the fingers back into a catching position. However in very deep, deviated wells it is very difficult to disengage such a J-slot type catcher and for this reason the type of packer catcher which has frangible pins supporting the retriever fingers or which uses interlocking screw threads has become more widely used even though such packer retrievers have the disadvantage that they need to be brought to the surface for refurbishment before they can be re-entered through a packer. In view of the considerable time and of such refurbishment and the necessity for at least two strokes of the drill string with the inherent high cost involved such packer catchers are therefore disadvantageous.

A packer catcher (retriever) utilising the apparatus of this invention is able to pass through a packer and to release the packer upon a predetermined load being met so an associated milling tool can remove the obstruction and for the retriever to re-enter through the packer without a complete second stroke of the drilling string being necessary.

Referring now to FIGS. 30 and 31 a retriever using the apparatus of this invention has the left hand end, as viewed in FIG. 30, of the tubular member 1 connected, in use, inside an adjacent part of the drill string 91 by a substantially parallel screw thread 92 and is secured thereto by an anti-back-off device. The drill string 91 could carry a washover shoe type of mill and to the right hand end of the tubular member 1 there could be supported by a tapered screw thread 93 a pilot mill (the mills not being shown).

The anti-back-off device comprises a generally v-shaped notch 94 in the wall of the member 1 and a set screw 95 located by a screw thread in the drill string 91 and engaging with a wall of the v-shaped notch 94. The provision of the anti-back-off device prevents the member 1 becoming unscrewed from the drill string 91.

The arrangement of the radially movable members 4 is similar to that described in the alternative embodiment of FIG. 8(*c*). In this respect the ring 2 is integral with member 1 and the member 4 is integral with ring 3, pressure being applied to the member 4 only through ring 3. As shown particularly in FIG. 31, the ring 3 and member 4 is constituted by a catch sleeve having three or more longitudinal, blind slots 496 in the side wall of the member 4 so as to thereby provide spring fingers. The outer extremity of each spring finger has a radially enlarged outer surface provided with tapers 400, 401 facing in opposing longitudinal directions of the sleeve, the tapers subtending an angle of 30° to the longitudinal axis of the sleeve so that it may be pushed through and retracted from a restriction in a pipe in use. The taper 201 on the inside surface of the outer extremity of the sleeve for cooperating with the taper 200 on the ring 2 is arranged to subtend an angle of 50° to the longitudinal axis of the sleeve. The inside end of the sleeve remote from the enlarged end is provided with a longitudinal slot 497 for cooperation with a key 96 located on the tubular member 1 so that rotation of the sleeve with respect to the member 1 is prevented.

A counter bored sleeve 97 is located on the member 1 with the open end of the sleeve 97 enclosing the ring 3 of the catch sleeve. A mechanical spring 31 is located in the counter bore and constrained between the blind end of the counter bore and an end of the ring 3. The spring 31 is formed by a plurality of disk springs. Mounted between the sleeve 97 and the drill string 91 is a box load adjuster 98 which has an internal screw thread cooperating with an external screw thread on the left hand end (as viewed in FIG. 30) of the sleeve 97. Thus by turning the sleeve 97 relative to the box load adjuster 98 so the force exerted by the spring 31 upon the ring 3 maybe adjusted. A set screw 99 is provided for locking the box load adjuster 98 to the sleeve 97.

A collapsible sleeve 700 having the general appearance of the catch sleeve but without the enlarged radial end thereof may be mounted inside the catch sleeve to prevent the ingress of dirt etc. through the slots 94 which could prevent the spring fingers of the catch sleeve from contracting.

In operation the required amount of pressure to be exerted on the catch sleeve represented by the ring 3 and integral radially movable spring finger members 4 is governed by the spring 31 and this force is preset before use of the retriever by suitably positioning sleeve 97. In use of the retriever it is lowered into a tubular to be retrieved and pushed through the tubular to be retrieved by the tapers 400 forcing the fingers to collapse at the outer ends thereof so that the fingers flex about the join thereof with ring 3. Once the catch sleeve has been pushed through the tubular to be retrieved then the fingers open due to the force exerted by spring 31 and movement of taper 201 along taper 200. The tubular to be retrieved is then cut by a cutting tool (not shown) and because the tubular to be retrieved rests upon taper 401 so lifting of the drill string causes the tubular to be retrieved when lifted with the drill string. If, for some reason, the tubular to be retrieved should become snagged or it otherwise becomes necessary to withdraw the retriever from the tubular then an upward pull on the drill string will cause the taper 401 to abraid against the inside of the tubular causing taper 201 to slide radially inwardly along taper 200 and the spring fingers thereby collapsing. Such collapsing of the spring fingers occurs when the force exerted on the drill string exceeds that produced by the spring 31 plus frictional force along the tapers. The use of the retriever of this invention thus overcomes the difficulty associated with prior art retrievers of engaging and re-engaging a J-slot and also the need for redressing frangible pins. In this respect the spring fingers of the retriever of this invention may be inserted and removed from a tubular to be retrieved any number of times with ease and without the necessity for the retriever to be withdrawn to the surface for replacement of frangible elements.

The key 96 is provided to prevent the catch sleeve from rotating so that if the retriever is used without the collapsible shield 700 then if the taper 401 is brought into engagement with the underside of the tubular, by rotating the retriever the radial enlargement may be burned off by friction so that the retriever may be withdrawn. It is, however, to be understood that the provision of such a key is meant only as an emergency release mechanism and if the shield 700 is used it is not thought such an emergency release mechanism will be necessary.

I claim:

1. A variable outside diameter tool for use in pipewells including a support tubular member for connection to a drilling string, a longitudinal axis of said support tubular member, an external surface of said support tubular member supporting a movable member which is axially movable therealong and a further member axially spaced from said movable member, a radially movable member which is movable in a radial direction with respect to said longitudinal axis toward and away respectively from said exertanl surface, said radially movable member being supported radially outwardly from said support tubular member by said axially movable member and said further member, a taper on a radially outer side from said longitudinal axis on at least one of said axially movable member and said further member, a complementary taper with said taper on a radially inner side of the radially movable member for sliding abutment between said complementary taper and said taper, a radially outer surface of said radially movable member having a pair of oppositely angled tapers facing in opposing longitudinal axial directions, and resilient means for exerting a resilient force on said axially movable member in an axial direction toward said further member to urge said radially movable member along said sliding abutment in a radially outward direction from said longitudinal axis and whereby when a leading one of said oppositely angled tapers meets an obstruction in a pipewell and the reactive force produced therebetween exceeds said resilient force then said radially movable member is thereby urged inwardly so that said sliding abutment moves the axially movable member away from said further member against the force of said resilient means.

2. A tool as claimed in claim 1 wherein all of said members have a generally at least part circular cross-section in a plane perpendicular to the support tubular member longitudinal axis.

3. A tool as claimed in claim 1 wherein when said taper is provided only on said further member the axially movable member is integrally connected with the radially movable member and said integral connection comprises a flexing means.

4. A tool as claimed in claim 3 wherein the axially movable member and the radially movable member are formed by a tubular sleeve having a plurality of circumferentially spaced longitudinal slots in the outer side wall thereof extending from an extreme outer end of the sleeve to a portion along the length of the sleeve to thereby provide spring fingers having radially movable outer ends, said outer end of the sleeve being radially enlarged on the outer surface thereof and provide with said oppositely angled tapers facing in each logitudinal direction of the sleeve so that the sleeve can be both pushed through and retracted from a restriction in a pipewell, and said complimentary taper being provided on an inner surface of the enlarged outer end for cooperating with the taper on the radially outer side of said further member.

5. A tool as claimed in claim 1 wherein the axially movable member, the further member and the radially movable member are arranged to rotate about the support tubular member.

6. A tool as claimed in claim 1 wherein the axially movable member and the further member are both secured against rotational movement about the support tubular member.

7. A tool as claimed in claim 1 wherein the resilient means may be one of mechanical, pneumatic and hydro-pneumatic.

8. A tool as claimed in claim 1 wherein a stop member is interposed between the axially movable member and the further member to limit the axial movement of said axially movable member toward said further member.

9. A tool as claimed in claim 1, wherein an angle subtended by each of the oppositely angled tapers with respect to a perpendicular to the longitudinal axis has a limit of Arc tan (f e/w) where f e/w is the friction factor between the radially movable member and the obstruction.

10. A tool as claimed in claim 1, wherein the further member is integrally formed with the support tubular member.

11. A tool as claimed in claim 1, wherein the further member is discretely formed and subsequently securely fixed to the support tubular member.

12. A tool as claimed in claim 1, wherein the angle subtended by said taper to said longitudinal axis is in the range greater than Arc tan (f r/e) less than [90-Arc tan (f r/e)] where f r/e is a friction factor of the sliding abutment between the radially movable member and said axially movable member and said further member.

13. A tool as claimed in claim 1, wherein the further member is located on the support tubular member by a longitudinal spline to permit longitudinal movement only thereof and a stop means is provided to limit the longitudinal movement thereof.

14. A drill string stabiliser comprising a tubular member having a longitudinal axis, an external surface of said tubular member supporting a first circumferentially rotatable member and a second circumferentially rotatable member, the first and second circumferentially rotatable members being axially spaced from one another and resilient means being provided for producing a resilient force to urge said first and second circumferentially rotatable members toward one another, a radially movable member which is movable in a radial direction with respect to said longitudinal axis toward and away respectively from said external surface, said radially movable member being supported by the first and second circumferentially rotatable members, there being a taper on a radially outer side from said longitudinal axis on at least one of the first and second circumferentially rotatable members, a complementary taper with said taper on a radially inner side of the radially movable member for sliding abutment between said complementary taper and said taper, a radially outer surface of said radially movable member having a pair of oppositely angled tapers facing in opposing longitudinal axial directions, whereby said resilient means urges the first and second circumferentially rotatable members toward one another so as to urge the radially movable member along said sliding abutment radially outwardly from said longitudinal axis, and when said oppositely angled tapers meet an obstruction in a pipewell and the reactive force produced therebetween exceeds said resilient force then the radially movable member is urged inwardly along said sliding abutment to move the first and second circumferentially rotatable members axially apart against the force of said resilient means.

15. An underreamer for use downhole comprising a support tubular member having a longitudinal axis for connection to a drilling string, an external surface of said support tubular member supporting a movable member which is axially movable therealong and a further member axially spaced from said movable member, a radially movable member which is movable in a radial direction with respect to said longitudinal axis toward and away respectively from said external surface, said radially movable member being supported radially outwardly from said support tubular member by said axially movable member and said further member, a taper on a radially outer side from said longitudinal axis on at least one of said axially movable member and said further member, a complementary taper with said taper on a radially inner side of the radially movable member for sliding abutment between said complementary taper and said taper to permit expansion and contraction respectively of said radially movable member, a radially outer surface of said radially movable member having a pair of oppositely angled tapers facing in opposing longitudinal axial directions, resilient means for exerting a resilient force on said axially movable member in an axial direction toward said further member to urge said radially movable member along said sliding abutment in a radially outward direction from said longitudinal axis, and cutting means provided on a downhole facing one of said oppositely angled tapers and whereby when a leading one of said oppositely angled tapers meets an obstruction in a pipewell and the reactive force produced therebetween exceeds said resilient force then said radially movable member is thereby urged inwardly so that said sliding abutment moves the axially movable member away from said further member against the force of said resilient means.

16. An underreamer as claimed in claim 15 wherein said further member is arranged to be fixedly secured to the support tubular member and the axially movable member is provided with releasable locking means to releasably secure said axially movable member in a position in which the radially movable member is contracted.

17. A packer retriever comprising a support tubular member for connection to a drilling string, a longitudinal axis of said tubular member, an external surface of said support tubular member supporting a movable member which is axially movable therealong and a further member axially spaced from said movable member, a radially movable member defining a packer catching portion which is movable in a radial direction with respect to said longitudinal axis toward and away respectively from said external surface, said radially movable member being supported radially outwardly from said support tubular member by said axially movable member and said further member, a taper on a radially outer side from said longitudinal axis on at least one of said axially movable member and said further member, a complementary taper with said taper on a radially inner side of the radially movable member for sliding abutment between said complementary taper and said taper, a radially outer surface of said radially movable member having a pair of oppositely angled tapers facing in opposing longitudinal axial directions, and resilient means for exerting a resilient force on said axially movable member in an axial direction toward said further member to urge said radially movable member along said sliding abutment in a radially outward direction from said longitudinal axis and whereby when a leading one of said oppositely angled tapers meets an obstruction in a central bore of a packer and the reactive force produced therebetween exceeds said resilient force then said radially movable member is thereby urged inwardly so that said sliding abutment moves the axially movable member away from said further member against the force of said resilient means.

18. A packer retriever as claimed in claim 17 wherein the support tubular member is connected to a drill string by an external screw thread on said support tubular member mating with an internal screw thread on said drill string, a portion of said support tubular member longitundinally axially adjacent the mating screw threads being located within a bore of said drill string, a generally v-shaped notch being formed in an outer wall of said portion of the support tubular member, and a locking means being inserted through a side wall of the drill string onto a wall of the v-shaped notch to thereby prevent the support tubular member unscrewing from the drill string.

19. A packer retriever as claimed in claim 18 wherein a collapsible shield is mounted between the radially movable member and the support tubular member to prevent ingress of dirt therebetween.

20. A packer retriever as claimed in claim 17, wherein the axially movable member and the radially movable member are formed by a tubular first sleeve having a plurality of circumferentially spaced longitudinal slots in the outer side wall thereof extending from an extreme outer end of the first sleeve to a position along the length of the first sleeve to thereby provide spring fingers having radially movable outer ends, said outer end of the first sleeve being radially enlarged to define said catching portion and being provided with said oppositely angled tapers facing in each longitudinal direction of the first sleeve so that the first sleeve can be both pushed through and retracted from a restriction in said packer central bore, and said complementary taper being provided on an inner surface of the enlarged outer end for cooperating with the taper on the radially outer side of said further member.

21. A packer retriever as claimed in claim 20 wherein a key means is provided to prevent rotation of the first sleeve with respect to the support tubular member.

22. A packer retriever as claimed in claim 20, wherein a second sleeve is positioned on said support tubular member, an internal portion of said second sleeve having an enlarged diameter to enclose an end of said first sleeve remote from said outer end, a mechanical spring means is enclosed in the enlarged diameter of said internal portion between an inner wall thereof and said support tubular member for exerting a force between an inner end wall of the enlarged diameter internal portion and said first sleeve and means for predeterminedly adjusting the force exerted by said spring means.

23. A packer retriever as claimed in claim 22 wherein the axial position of the second sleeve relative to the first sleeve is adjustable to vary the force exerted by the spring means.

24. A variable outside diameter tool for use in pipewells including a support tubular member for connection to a drilling string, a longitudinal axis of said support tubular member, an external surface of said tubular member supporting a movable member which is arranged to be axially movable along said tubular member and also circumferentially rotatable thereabout, and a further member which is arranged to be circumferentially rotatable about the tubular member and axially spaced from said axially movable member, a radially movable member which is movable in a radial direction with respect to said longitudinal axis toward and away respectively from said external surface, said radially movable member being supported radially outwardly from said tubular member by said axially movable member and said further member, a taper on a radially outer side of said longitundinal axis on at least one of said axially movable member and said further member, a complementary taper with said taper on a radially inner side of the radially movable member for sliding abutment between said complementary taper and said taper, a radially outer surface of said radially movable member having a pair of oppositely angled tapers facing in opposing longitudinal directions, and resilient means for exerting a resilient force on said axially movable member in an axial direction toward said further member to urge said radially movable member along said sliding abutment in a radially outward direction from said longitudinal axis, and whereby when a leading one of said oppositely angled tapers meets an obstruction in a pipewell and the reactive force produced therebetween exceeds said resilient force then said radially movable member is thereby urged inwardly so that said sliding abutment moves the axially movable member away from said further member against the force of said resilient means.

25. A packer retriever comprising a support tubular member having a longitudinal axis for connection to a drill string by an external screw thread on said support tubular member mating with an internal screw thread on said drill string, a portion of said support tubular member longitudinally adjacent the mating screw threads being located within a bore of said drill string, a generally V-shaped notch formed in an outer wall of said portion of the support tubular member, a locking means inserted through a sidewall of the drill string into a wall of the V-shaped notch to thereby prevent the support tubular member unscrewing from the drill string, an external surface of said support tubular member supporting a movable member which is axially movable therealong, and a further member axially spaced from said movable member, a radially movable member defining a packer catching portion which is movable in a radial direction with respect to said longitudinal axis toward and away respectively from said external surface, said radially movable member being supported radially outwardly from said support tubular member by said axially movable member and said further member, a taper on a radially outer side form said longitundinal axis on at least one of said axially movable member and said further member, a complementary taper with said taper on a radially inner side of the radially movable member for sliding abutment between said complementary taper and said taper, a radially outer surface of said radially movable member having a pair of oppositely angled tapers facing in opposing longitudinal axial directions, and resilient means for exerting a resilient force on said axially movable member in an axial direction toward said further member to urge said radially movable member along said sliding abutment in a radially outward direction from said longitudinal axis and means for adjusting said resilient force whereby when a leading one of said oppositely angled tapers meets an obstruction in a pipewell and the reactive force produced therebetween exceeds said resilient force then said radially movable member is thereby urged inwardly so that said sliding abutment moves the axially movable member away from said further member against the force of said resilient means, and wherein a collapsible sheild is mounted between the radially movable member and the support tubular member for preventing ingress of dirt therebetween.

* * * * *